United States Patent [19]

Lau

[11] Patent Number: 4,690,468

[45] Date of Patent: Sep. 1, 1987

[54] REVERSIBLE HINGE WITH OVER-CENTER SPRING FOR REFRIGERATORS

[75] Inventor: Robert G. Lau, Evansville, Ind.

[73] Assignee: Whirlpool Corporation, Benton Harbor, Mich.

[21] Appl. No.: 833,036

[22] Filed: Feb. 26, 1986

[51] Int. Cl.[4] ..... A47B 47/00

[52] U.S. Cl. ..... 312/291; 16/291; 16/293; 49/382; 49/386

[58] Field of Search ..... 312/291, 292, 319, 138, 312/109; 16/291, 293; 49/382; 386

[56] References Cited

U.S. PATENT DOCUMENTS

| | | | |
|---|---|---|---|
| 527,158 | 10/1894 | Rippien | 16/280 |
| 1,537,379 | 5/1925 | Scott | 16/72 |
| 2,302,385 | 11/1942 | Anderson | 312/291 X |
| 2,505,467 | 4/1950 | Eilert | 16/281 X |
| 2,543,600 | 2/1951 | Roethel | 16/291 |
| 2,634,465 | 4/1953 | Carbary | 16/72 X |
| 4,067,145 | 1/1978 | Hodge | 49/386 |
| 4,503,582 | 3/1985 | Malchow | 16/232 |

*Primary Examiner*—Joseph Falk

*Attorney, Agent, or Firm*—Hill, Van Santen, Steadman & Simpson

[57] ABSTRACT

A reversible hinge for use on a freezer compartment door of a single door refrigerator includes a stationary leaf for mounting to the refrigerator cabinet and a movable leaf for mounting to the freezer compartment door, as well as a tension spring extending therebetween to provide bias toward either an open position or a closed position. The spring is connected between a first pair of tabs when the hinge is mounted for left-hand opening of the freezer compartment door and between a second pair of tabs when the hinge is mounted for right-hand opening of the freezer compartment door.

6 Claims, 6 Drawing Figures

REVERSIBLE HINGE WITH OVER-CENTER SPRING FOR REFRIGERATORS

BACKGROUND OF THE INVENTION

1. Field of the Invention

The present invention relates generally to a reversible spring-biased hinge for use on inner freezer compartment doors of single door refrigerators.

2. Description of the Prior Art

It is known in the art to provide evaporator compartment doors of refrigerators with an over-center spring to bias the door to both the open and closed positions. The art recognizes the problem of an evaporator compartment door which is hinged at a first side while a main refrigerator door is hinged at an opposite side of a refrigerator. This problem is overcome in U. S. Pat. No. 2,634,465 which discloses a door biasing assembly which is changeable from being biased toward either the open position or the closed position to being biased only toward the closed position so that the evaporator door is not damaged by the accidental closing of an oppositely hinged refrigerator door.

Over-center springs are disclosed in U.S. Pat. Nos. 1,537,379 and 2,505,467 for use on doors and gates, respectively.

A reversible spring hinge is disclosed in U.S. Pat. No. 527,158 which uses a coiled spring encircling the pintle, or hinge pin, and may be mounted either as a surface hinge or as a double swing mortise hinge.

A double-acting refrigerator door hinge and sliding lock-bolt is disclosed in U.S. Pat. No. 4,503,582 which includes pairs of hinge pins at each side of the door and a slide bar which locks one of the pairs of hinge pins in place while enabling the other pair to move outwardly so that the door is selectively openable from either side by shifting the slide bar.

SUMMARY OF THE INVENTION

The present invention enables an evaporator, or freezer, door of a single door refrigerator to be hinged from either side and, when hinged on either of the sides, to be biased toward either an open position or a closed position. It is common practice to provide a reversible hinge mechanism on the external door of a refrigerator so that the refrigerator may be opened from either the right or the left side. When the opening direction of the external refrigerator door is changed, it is also desirable that the internal freezer compartment door be openable in a like direction. This enables the freezer compartment to be easily accessed by the user and also avoids damage to the freezer door such as might occur, for example, when a right-hand hinged outer door is closed on an open left-hand hinged inner door.

The present invention is embodied in a reversible hinge that includes a stationary leaf for mounting to the refrigerator and a movable leaf for mounting on the freezer compartment door and connected to the stationary leaf by a pivot pin. Each leaf is provided with a pair of spaced tabs, one of each pair being connected to each end of an energy storing device such as a spring. The spring provides tension to bias the door toward the closed position, or when toggled to an over-center position, provides tension to bias the door toward an open position. The present hinge provides such bi-directional biasing when mounted for right-hand closing of the freezer compartment door and, by changing the spring connection to between the other ones of the tab pairs, when mounted for left-hand closing.

Thus, there is provided an inexpensive and simple reversible spring hinge that can be mounted for either right-hand opening or left-hand opening that has means for bi-directional biasing in either mounting simply by reconnecting a spring.

DESCRIPTION OF THE PREFERRED EMBODIMENT

Figure 1:
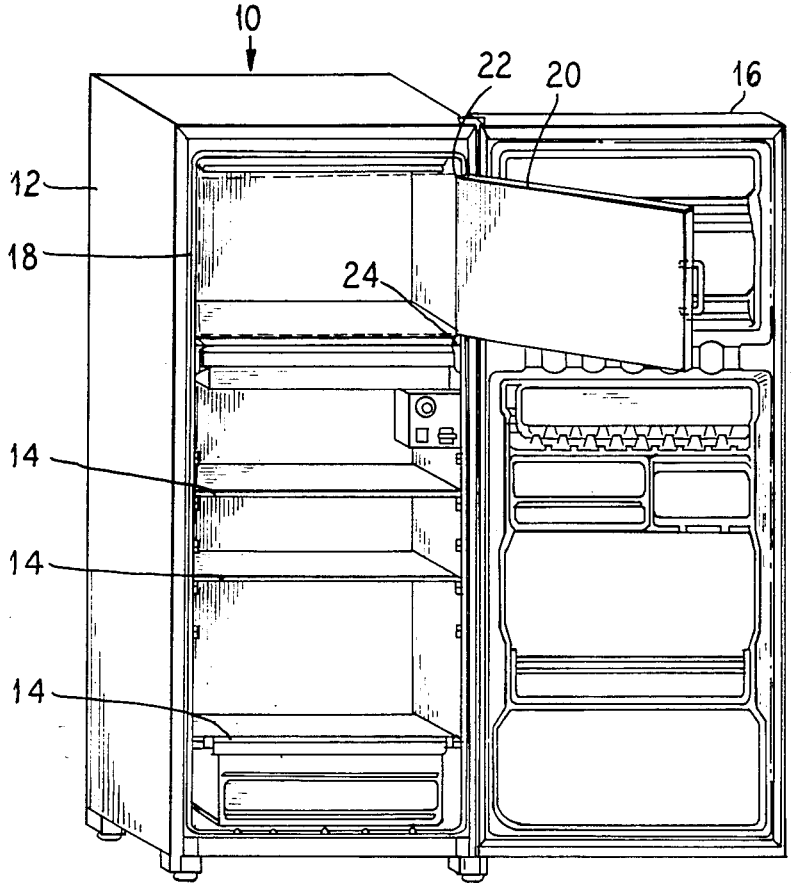
FIG. 1 is a perspective view of a single door refrigerator including a reversible hinge according to the principles of the present invention.

In FIG. 1, a refrigerator is shown generally at 10 including an insulated cabinet 12 having a plurality of shelves 14 mounted at spaced locations therein, an openable door 16 hingedly mounted to the cabinet 12 and a freezer, or evaporator, compartment 18 having a hingedly mounted door 20 thereon. The external refrigerator door 16 can be mounted to open to the right (as shown) or to open to the left.

Figure 2:
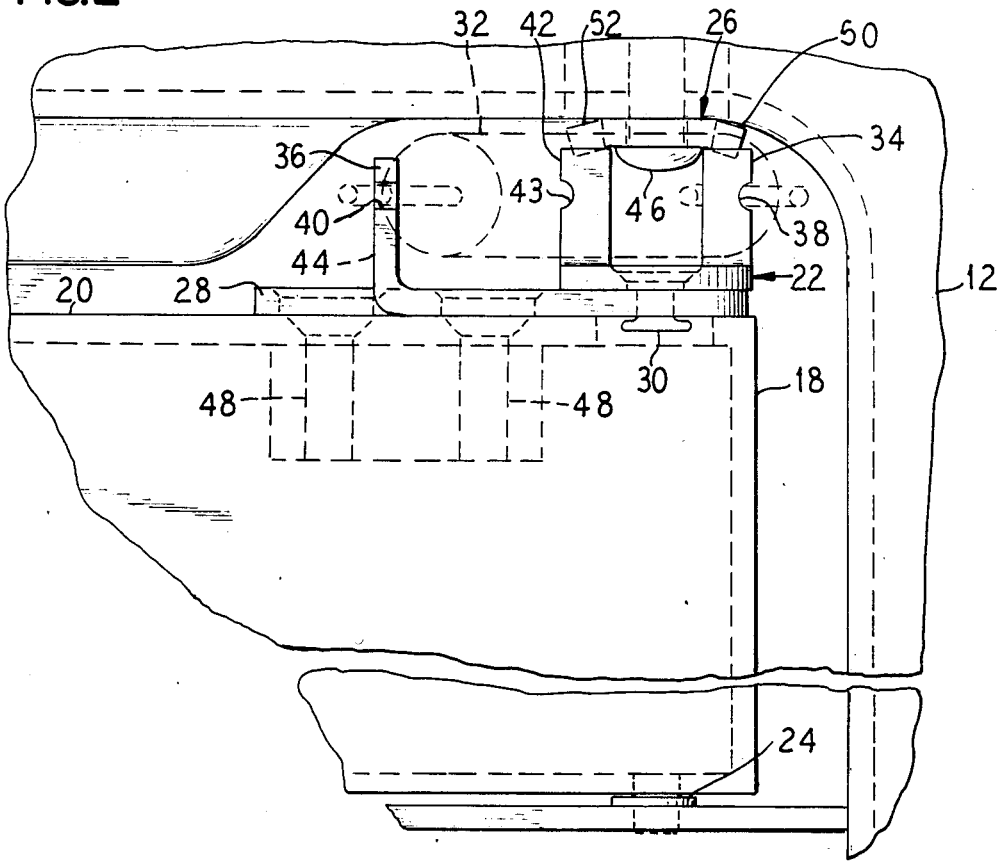
FIG. 2 is an enlarged fragmentary elevational view showing the reversible hinge of FIG. 1.

The freezer compartment door 20 is mounted for pivotal opening to the right by a reversible hinge 22 adjacent a top right corner thereof and by a pivot pin hinge 24 adjacent a lower right corner thereof. In FIG. 2, the reversible hinge 22 includes a stationary leaf 26 mounted to the refrigerator cabinet 12 and a movable leaf 28 mounted to the freezer compartment door 20. Connected between the stationary leaf 26 and the movable leaf 28 is a rivet-type hinge pin 30 and an energy storage device 32. While the device 32 can take various forms, a convenient form exemplified in the present disclosure is a helically coiled tension spring 32 having a conencting means 32A and 32B at opposite ends thereof and respectively connected between a tab 34 on the stationary part and a tab 36 on the movable part at notches 38 and 40, respectively. Additional tabs 42 and 44 (behind tab 36 in FIG. 2) are included for mounting the bias spring 32 and include similar notches 43 and 45 (FIG. 5) respectively. The stationary leaf 26 of the hinge 22 is mounted to the refrigerator cabinet 12 by mounting bolts 46 and the movable leaf 28 is connected to the freezer compartment door 20 by mounting bolts 48. On either side of the bolts 46 at the edges 50 and 52 the stationary leaf 26 is curved to accomodate any curves in the refrigerator cabinet 12.

Figure 3:
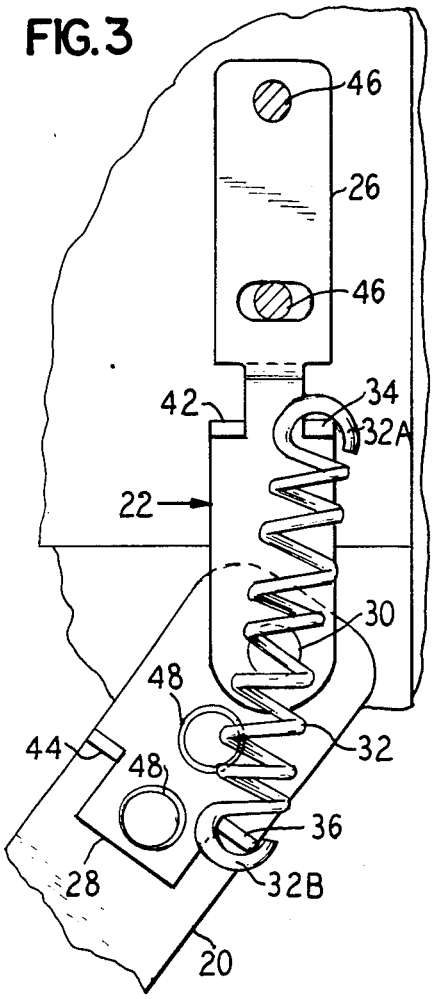
FIG. 3 is a top plan view of the reversible hinge of FIG. 1 in an in-line position.

In FIG. 3, the biasing spring 32 is connected to extend between the tabs 34 and 36 which are substantially in line with the pivot pin 30. In this position, the freezer compartment door 20 is neither biased to the open nor closed position. However, the slightest movement of the door 20 in either direction will move the tab 36 out of alignment with the tab 34 and the hinge pin 30 so that the spring 32 tension draws the tabs 34 and 36 toward one another to bias the door 20 in one direction or the other. The position shown in FIG. 3 is referred to as the center position and movement past the center position, or over-center, causes a change in bias direction.

Figure 4:
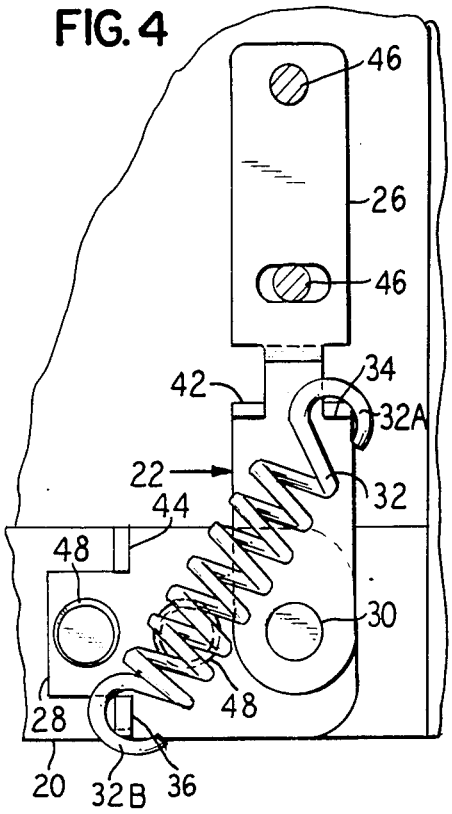
FIG. 4 is a top plan view of the hinge of FIG. 1 with the freezer compartment door in a closed position.

In FIG. 4, the door 20 is closed against the front of the freezer compartment 18 and the hinge 22 is biased to the closed position by tension in the spring 32 between the tabs 34 and 36.

Figure 5:
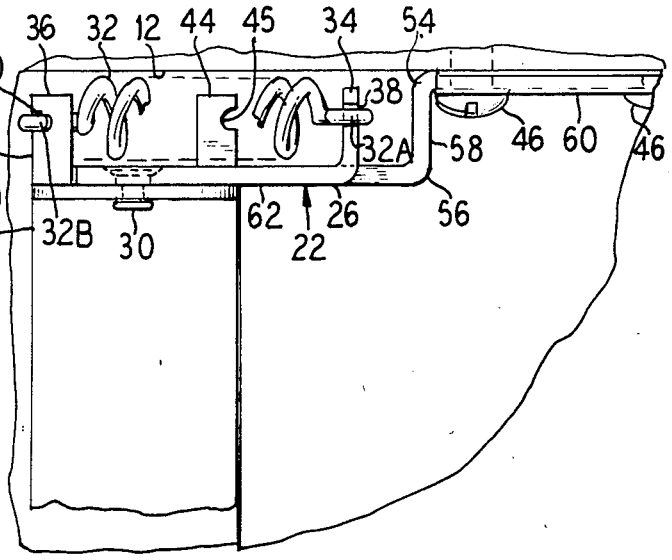
FIG. 5 is a side elevational view of the hinge of FIG. 4 as seen from the right.

In the side view of FIG. 5, double reverse bends 54 and 56 of the stationary leaf 26 can be seen more clearly including a vertical portion 58 between a mounting portion 60 mounted to the freezer cabinet 12 and a pivot portion 62 having the tabs 34 and 42 and the hinge pin 30. The bends 54 and 56 and the vertical portion 58 provide clearance for the spring 32 and the tabs 34, 36, 42 and 44 from the cabinet 12. Each of the two leaves 26 and 28 are preferably formed of stamped sheet metal and are thus strong yet inexpensive.

Figure 6:
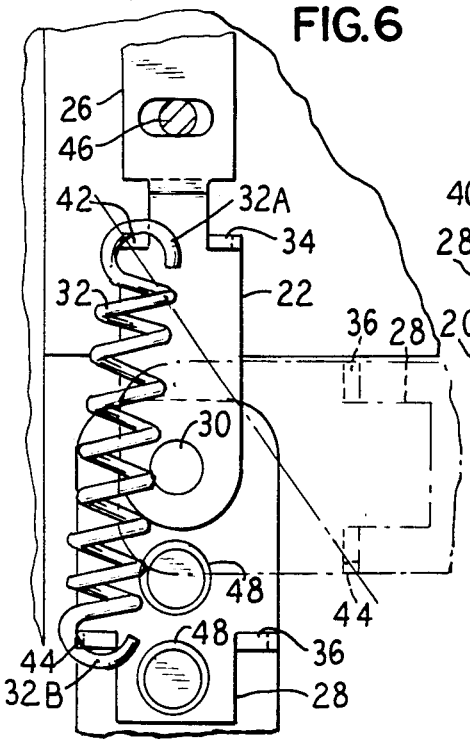
FIG. 6 is a top plan view of the hinge of the present invention mounted for left-wârd opening and shown with the freezer compartment door in an opened position and, in dotted outline, in a closed position.

The hinge 22 of the present invention can be removed from its right-hand orientation and installed in a left-hand orientation as shown in FIG. 6. When in the left-hand orientation, the stationary leaf 26 is mounted to the freezer cabinet 12 at the left side of the freezer compartment 18 and the movable leaf 28 is mounted to the freezer compartment door 20 adjacent its left-hand corner. To provide bi-directional bias in such reverse installation, the coil tension spring 32 is disconnected from the tabs 34 and 36 and is reinstalled on the tabs 42 and 44, preferably at the notches 43 and 45. The spring 32 thereby biases the door 20 toward the opened position, as shown in FIG. 6 in solid outline, and toward the closed position, as shown in FIG. 6 in dotted outline. The present hinge 22 may also be mounted initially fro left-ward opening of the freezer compartment door 20.

Thus, there has been shown and described a reversible hinge 22 for mounting on a freezer compartment door 20 of a single door refrigerator 10 which may be mounted at either side of the freezer compartment 18. Simply changing the connection of a tension spring 32 from one pair of tabs to a second pair of tabs provides biasing in both the opened and closed positions at either orientation. Changing bias directions is accomplished by opening, or respectively closing, the door 20 until the spring 32 toggles, or is moved over-center, so that the door 20 tends to stay open or, respectively closed. Closing of the outer door 16 while the inner door 20 is open merely closes the inner door 20, rather than damaging it. Therefore, the present reversible hinge provides a cost effective yet efficient means for bi-directionally biasing a door from either side.

As is apparent from the foregoing specification, the present invention is susceptible to being embodied with various alterations and modifications which may differ particularly from those that I have described in the preceding specification and description. It should be understood that I wish to embody within the scope of the patent granted hereon all such modifications as reasonably and properly come within the scope of my contribution to the art.

The embodiments of the invention in which an exclusive property or privilege is claimed are defined as follows:

1. In a refrigerator having a single external door mounted on a cabinet and an inner freezer compartment door at an opening of a freezer compartment, an improved hinge comprising:

a stationary leaf for mounting to the refrigerator cabinet at a first side of said opening to said freezer compartment and alternately at a second side of said opening, said stationary leaf including first and second tabs extending therefrom in spaced apart disposition from one another;

a movable leaf for mounting to said freezer compartment door including third and fourth tabs extending therefrom in spaced apart disposition from one another, said movable leaf being mounted adjacent a first edge of said compartment door when said stationary leaf is at said first side of said opening and said movable leaf being mounted adjacent a second edge of said compartment door when said stationary leaf is at said second side of said opening;

a hinge pin pivotably connecting said stationary leaf to said movable leaf;

said movable leaf being pivotable to a first center position having said first tab and said third tab in-line with said hinge pin, said movable leaf being pivotable to a second center position different than said first center position, said second center position having said second tab and said fourth tab in-line with said hinge pin; and an energy storing spring having a first end connected to one of said first and second tabs and a second opposite end connected to one of said third and fourth tabs, said spring biasing said movable leaf in a first pivotal direction with respect to said stationary leaf and when a predetermined movement of said movable leaf occurs past a respective one of said first and second center positions biasing said movable leaf in a second pivotal direction with respect to said secondary leaf;

whereby said first position corresponds to a closed position of said freezer compartment door and said second position corresponds to an open position of said freezer compartment door.

2. A hinge as claimed in claim 1, wherein said stationary leaf includes a pair of transverse bends in respective reverse directions, said transverse bends being between first and second portions of said stationary leaf, said first portion being fastened to the refrigerator cabinet and said second portion spaced from said refrigerator cabinet, said spring and said first and second tabs disposed between said second portion and said refrigerator cabinet.

3. A hinge as claimed in claim 1, further comprising spring end engaging notches on said first, second, third and fourth tabs, ends of said energy storing spring being connectible to said spring end engaging notches.

4. A hinge as defined in claim 1, wherein said energy storing spring comprises a helically coiled tension spring with connection means at opposite ends for coupling to said tabs.

5. A reversible hinge for use on freezer compartment doors of single door refrigerators having refrigerator cabinets, comprising:

a stationary leaf removably mounted to the refrigerator cabinet adjacent a first side of the freezer compartment door and alternately adjacent a second side of the freezer compartment door, said stationary leaf having a first planar portion and a second planar portion wherein said second planar portion is substantially in a plane parallel to a plane of said first planar portion, a connecting portion extending between said first and second planar portions, said second planar portion including first and second tabs extending substantially normal thereto in a direction toward the plane defined by said first planar portion, said first and second tabs each including a spring receiving notch;

a movable leaf pivotably. mounted to said stationary leaf at said second planar portion, said movable leaf being fixed to the first side of the freezer compartment door when said stationary leaf is mounted adjacent said first side of said door and said movable leaf being fixed to the second side of said door when said stationary leaf is mounted adjacent said second side of said door, said movable leaf including third and fourth tabs extending substantially normal thereto substantially parallel to said first and second tabs, said third and fourth tabs each having a spring receiving notch;

a pivot connecting said stationary leaf and said movable leaf and defining a pivot axis; a tension spring having a first end connected to said notch of said first tab and a second opposite end connected to said notch of said third tab when said stationary leaf is adjacent said first side of said door such that said spring biases said movable leaf in a first direction when said spring is on a first side of said pivot axis and biases said movable leaf in a second opposite direciton when said spring is on a side of said pivot axis opposite said first side, said spring being connected at said first end to said second tab and at said second end to said fourth tab for reverse operation of said hinge when said stationary leaf is adjacent said second side of said door, such that the change in biasing direction by said spring occurs at a different position of said movable leaf than when said stationary leaf is adjacent said first side of said door.

6. A reversible hinge for a freezer door on a freezer compartment of a refrigerator, comprising:

a first leaf selectively fixedly mounted at one of a first side of the freezer compartment and a second side of said freezer compartment wherein said second side is opposite said first side;

a second leaf selectively fixedly mounted at one of a first side of the freezer door and a second side of said freezer door wherein said second side is opposite said first side, said second leaf being mounted at said first side of the door when said first leaf is at said first side of the compartment and mounted at said second side of the door when said first leaf is at said second side of the compartment;

a pivot connecting said first leaf to said second leaf for pivoting movement of said second leaf in a pivot plane;

first and second tangs extending from said first leaf to the same side of said pivot plane, said first and second tangs being a fixed distance from said pivot;

third and fourth tangs extending from said second leaf each to the same side of said pivot plane as said first and second tangs, said third and fourth tangs being a fixed distance from said pivot;

said first tang moving into alignment with said pivot and said third tang as said second leaf is pivoted with respect to said first leaf in a first direction, further pivoting movement of said second leaf in said first direction moving said first tang out of alignment with said pivot and said third tang;

said second tang moving into alignment with said pivot and said fourth tang as said second leaf is pivoted with respect to said first leaf in said first direction, further pivoting movement of said second leaf in said first direction moving said second tang out of alignment with said pivot and said fourth tang; and means for biasing the pivoting movement of said second leaf with respect to said first leaf, said biasing means connected between said first tang and said third tang when said first leaf is mounted at said first side of the freezer compartment and said second leaf is mounted at said first side of said freezer door, said biasing means connected between said second tang and said fourth tang when said first leaf is mounted at said second side of the freezer compartment and said second leaf is mounted at said second side of said frezer door, said biasing means effecting a bias in a first pivotal direction, said biasing means effecting a bias alternately in a second pivotal direction after movement of said second leaf past alignment of said pivot with respective ones of said first and third tangs and said second and fourth tangs between which said biasing means is connected.

* * * * *